US008915169B2

(12) United States Patent
Chang et al.

(10) Patent No.: US 8,915,169 B2
(45) Date of Patent: Dec. 23, 2014

(54) ADJUSTABLE DRIVING TOOL

(71) Applicant: Yeh-Ching Chang, Taichung (TW)

(72) Inventors: Yeh-Ching Chang, Taichung (TW); Hsien-Cheng Lin, Taichung (TW)

(73) Assignee: Yeh-Ching Chang, Taichung (TW)

( * ) Notice: Subject to any disclaimer, the term of this patent is extended or adjusted under 35 U.S.C. 154(b) by 0 days.

(21) Appl. No.: 14/086,667

(22) Filed: Nov. 21, 2013

(65) Prior Publication Data

US 2014/0298960 A1 Oct. 9, 2014

(30) Foreign Application Priority Data

Apr. 9, 2013 (TW) ..... 102206414 U

(51) Int. Cl.
*B25B 23/16* (2006.01)
*B25G 1/06* (2006.01)

(52) U.S. Cl.
CPC ..... *B25G 1/066* (2013.01)
USPC ..... 81/177.8; 81/177.9

(58) Field of Classification Search
USPC ..... 81/177.8–177.9, 60
See application file for complete search history.

(56) References Cited

U.S. PATENT DOCUMENTS

| | | | | |
|---|---|---|---|---|
| 1,036,379 | A * | 8/1912 | Tibbals | 81/58.4 |
| 5,101,696 | A * | 4/1992 | Neff | 81/177.8 |
| 6,564,680 | B1 * | 5/2003 | Rinner et al. | 81/177.5 |
| 7,287,450 | B1 * | 10/2007 | Liao | 81/177.9 |
| 7,698,972 | B2 * | 4/2010 | Hi | 81/177.8 |
| 7,866,235 | B2 * | 1/2011 | Hi | 81/177.8 |
| 8,342,062 | B2 * | 1/2013 | Chen et al. | 81/177.9 |
| 8,656,811 | B2 * | 2/2014 | Ho | 81/177.8 |
| 2009/0223329 | A1 * | 9/2009 | Hi | 81/177.8 |
| 2012/0325057 | A1 * | 12/2012 | Ho | 81/60 |

FOREIGN PATENT DOCUMENTS

| | | |
|---|---|---|
| TW | M274211 | 9/2005 |
| TW | M315136 | 7/2007 |

* cited by examiner

*Primary Examiner* — Monica Carter
*Assistant Examiner* — Danny Hong
(74) *Attorney, Agent, or Firm* — Muncy, Geissler, Olds & Lowe, P.C.

(57) ABSTRACT

An adjustable driving tool includes a handle and a driving rod. The handle has a limiting portion disposed in the handle and a slot. The limiting portion has an inner space communicating with openings of a first sleeve portion and a second sleeve portion. The slot communicates with the inner space. The handle provided with a pin disposed through the inner space, and the first and second sleeve portions are disposed around the pin. The driving rod has a working end and a fixation end having an elongate through hole around the pin. The fixation end is disposed into the inner space through the slot. The driving rod is slidable relative to the pin, and the fixation end is controllably selectively inserted into the first sleeve portion or the second sleeve portion so that the driving rod is held.

15 Claims, 8 Drawing Sheets

ADJUSTABLE DRIVING TOOL

BACKGROUND OF THE INVENTION

1. Field of the Invention

The present invention relates to a driving tool, and more particularly to an adjustable driving tool.

2. Description of the Prior Art

TW M274211 discloses a foldable handle of a driver. The handle has many parts which have complicated structures, and is not easy to assemble and of high cost. Additionally, the push member is partially out of the handle, so that the tool is easy to be moved to release engagement of a front section and a rear section.

TW M315136 discloses a driver having an adjustable handle. The driver can be used in a straight structure or a T-type structure. In TW M315136, the blocking structure is disposed in the handle, in which a pivot hole and an axal hole are formed respectively on a lower wall and an upper wall within the receiving space. An adapting rod is formed with a pivot hole and an axal hole respectively on a lower wall and an upper wall thereof, in which the pivot hole and the axal hole of the adapting rod correspond respectively to the pivot hole and the axal hole of the blocking structure. A pivot is disposed between the handle and the adapting rod, the pivot is formed with a ring slot for clip of a C-type retaining ring, and a spring is disposed on the top end of the pivot. The spring abuts against a push botton which is movable up and down but unrotatable, and the push botton can be engaged with a bottom edge of the upper wall of the handle so as to prevent disassembling of the push botton, and the push botton can be engaged with the adapting rod via the blocking portion. However, the structure of TW M315136 needs to be formed with the ring slot for clip of a C-type retaining ring, one end of the pivot has to be formed with the push botton, and the spring should be further disposed between the push botton and the pivot, so that the function of limiting or releasing the adapting rod can be whereby achieved. Similarly, the driver of TW M315136 has many parts which have complicated structures, and is not easy to assemble and of high cost. In addition, the lock of the driver may be easily accidentally released.

US 2012/0325057 is directed to a foldable hand tool. The foldable hand tool has a handle and a tool's driving head. The tool is mainly characterized by that, the handle is provided with a driving head guide groove, which is extended along the handle and set correspondingly with the handle's long guide hole. The driving head guide groove penetrates one side of the handle. A combined lug is protruded from the assembly end of the tool's driving head, and fitted slidably with the driving head guide groove of the handle. When the tool's driving head swings perpendicular to the handle, it can slide along the driving head guide groove. However, the structure of US 2012/0325057 is complicated, and the structure provides insufficient engagement of the locking member when, especially the hand tool is adjusted to be configured into a straight pattern. Since there is no any part provided for abutment of the combined lug and the locking lug as the hand tool is configured into a straight pattern, the tool's driving head can be easily disengaged from the handle.

The present invention is, therefore, arisen to obviate or at least mitigate the above mention disadvantages.

SUMMARY OF THE INVENTION

An object of the present invention is to provide an adjustable driving tool which is simply and quickly to be adjusted, of a simple structure, easy to fabricate and of low production cost, and in which a driving rod can be effectively and stably held after adjusted, the structural strength is enhanced, and it is easy to assemble, disassemble and replace.

To achieve the above and other objects, an adjustable driving tool is provided. The adjustable driving tool includes a handle and a driving rod. The handle has a limiting portion and a slot. The limiting portion is disposed in the handle and includes an inner space, a first sleeve portion and a second sleeve portion. The first and second sleeve portions respectively have openings communicating with the inner space, and the slot communicates with the inner space and is open to an outside of the the handle. The handle is provided with a pin which is disposed through the inner space, and the first sleeve portion and the second sleeve portion are disposed around an axis of the pin. Either of the first and second sleeve portions has two corresponding abutting members which are substantially parallel to the axis of the pin. One of the first and second sleeve portions is entirely encompassed within the handle and located on a longitudinal central axis of the handle, and the longitudinal central axis is substantially perpendicular to the axis of the pin. The driving rod has a working end and a fixation end corresponding to the working end. The fixation end is formed with an elongate through hole extending along a longitudinal direction of the driving rod, and the pin is movably disposed in the elongate through hole. The fixation end is disposed into the inner space through the slot. The driving rod is slidable and swingable relative to the pin, and the fixation end is controllably selectively inserted into the first sleeve portion or the second sleeve portion and the fixation end abuts against the two abutting members of one of the first and second sleeve portions so that the driving rod is held.

To achieve the above and other objects, an adjustable driving tool is provided. The adjustable driving tool includes a handle and a driving rod. The handle has a limiting portion, a slot and a groove. The limiting portion is disposed in the handle and includes an inner space, a first sleeve portion and a second sleeve portion. The first and second sleeve portions respectively have openings communicating with the inner space. Either of the first and second sleeve portions has two corresponding abutting members which are substantially perpendicular to a longitudinal central axis of the handle. One of the first and second sleeve portions is entirely encompassed within the handle and on the longitudinal central axis of the handle. The slot communicates with the inner space and is open to an outside of the the handle. The groove at least includes two elongate section respectively communicate with and extend toward the first sleeve portion and the second sleeve portion. The driving rod has a working end and a fixation end corresponding to the working end. The driving rod is provided with a pin, and the fixation end is disposed into the inner space through the slot. The pin is slidably inserted into the groove. The driving rod is slidable and swingable within the groove through the pin and the fixation end is controllably selectively inserted into the first sleeve portion or the second sleeve portion and the fixation end abuts against the two abutting members of one of the first and second sleeve portions so that the driving rod is held.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
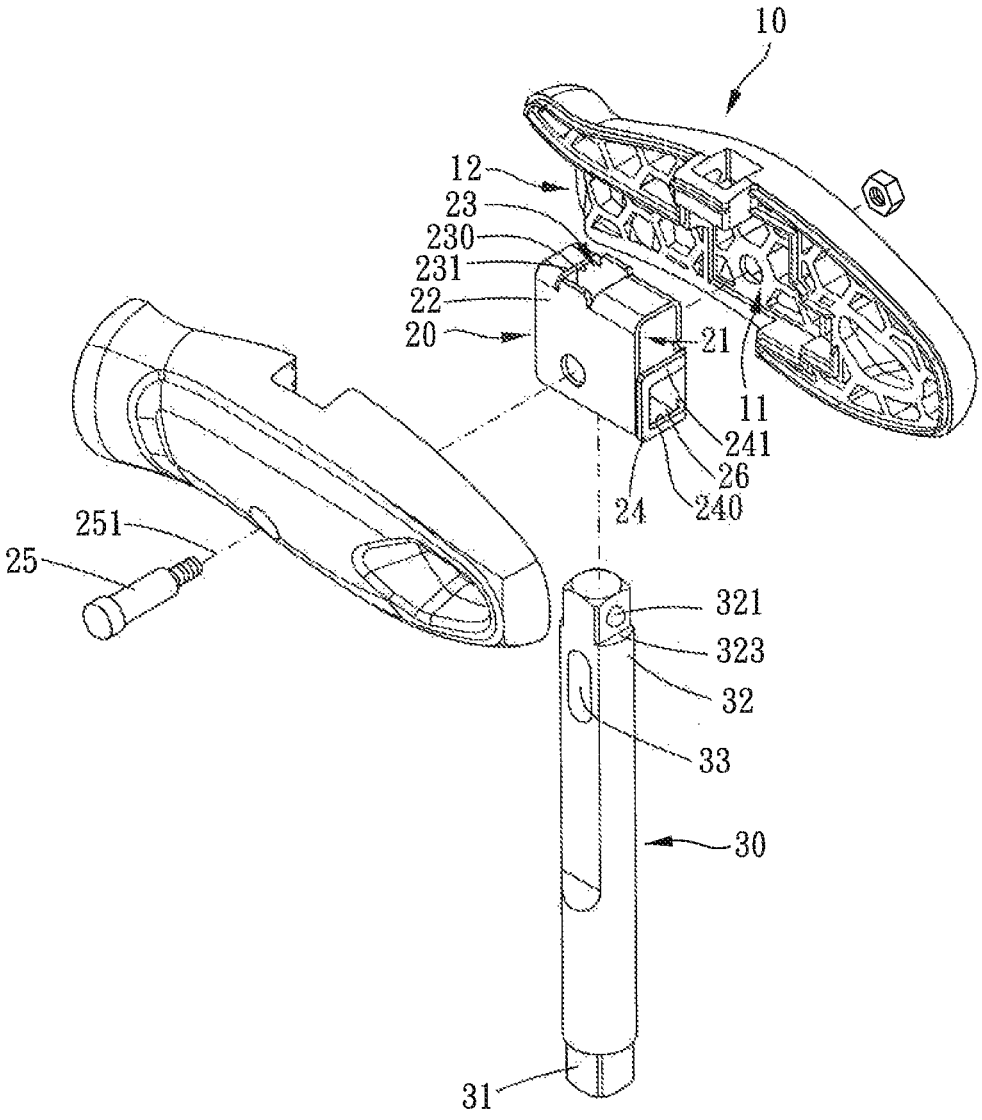
FIG. 1 is an exploded view according to a first embodiment of the present invention.
Figure 2:
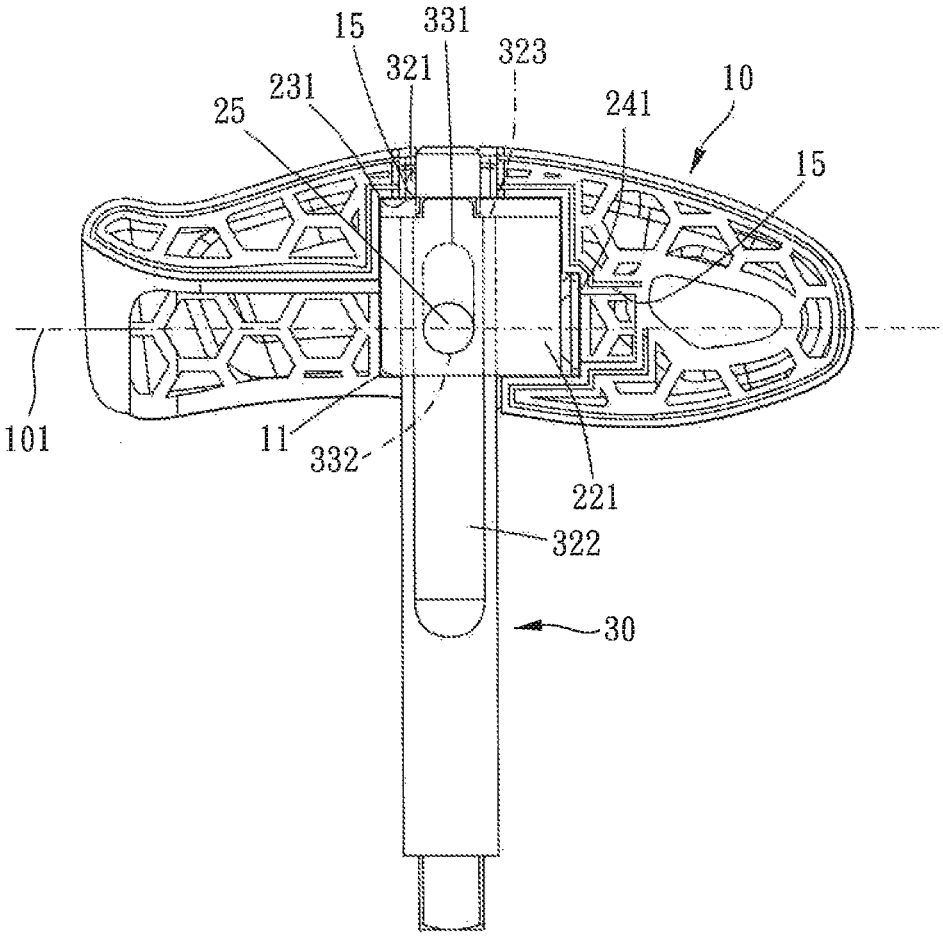
FIG. 2 is a cross-sectional view according to the first embodiment of the present invention.
Figure 3:
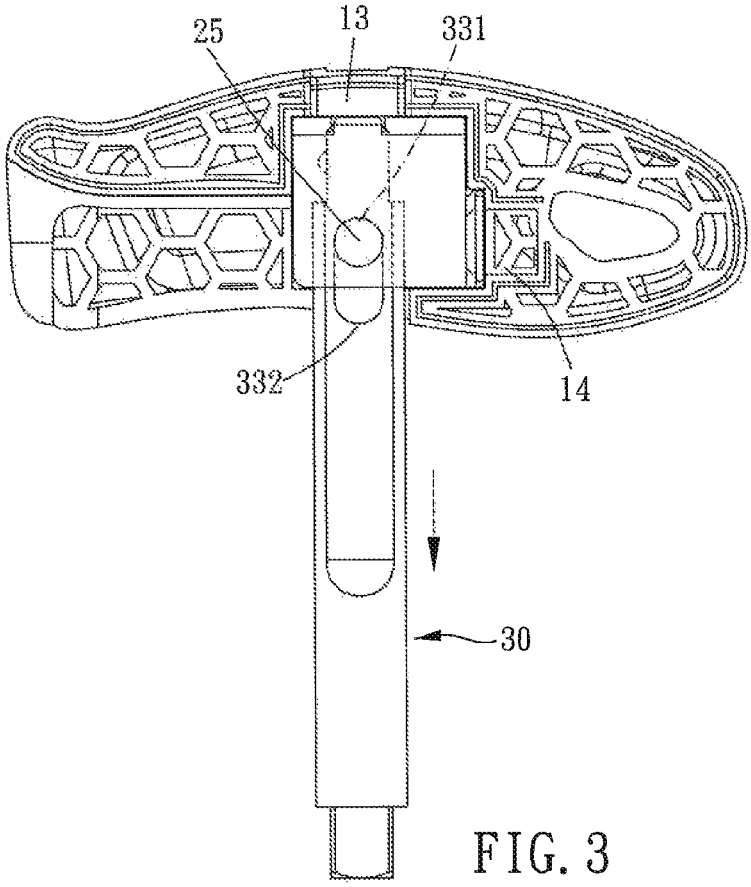
FIGS. 3 and 4 are views showing adjustment of an adjustable driving tool according to the first embodiment of the present invention.

FIGS. 1-3 show an adjustable driving tool according to a first embodiment of the present invention. The adjustable driving tool includes a handle 10, a limitation member 20 and a driving rod 30.

The handle 10 has a receiving space 11 and a slot 12 communicating with the receiving space 11, and the slot 12 is open to an outside of the handle 10. More specifically, the receiving space 11 is substantially square-shaped, and the slot 12 is continuously open from a frontal end to an intermediate of the handle 10. Preferably, the handle 10 has hollow structures there inside, thus reducing the material usage weight and cost. Additionally, the handle 10 is preferably fabricated by at least two detachable parts, thus facilitating assembling, disassembling and replacing of the limitation member 20, the driving rod 30 and the handle 10. However, the handle 10 may be integrally formed in one piece or fabricated by more than two detachable parts.

The limitation member 20 serves as a limiting portion for selectively limiting the driving rod 30. In this embodiment, the limitation member 20 is substantially square-shaped (preferably corresponding to the receiving space 11 in shape) and has dimensions substantially the same as that of the receiving space. The limitation member 20 is fixedly disposed in the receiving space 11 and has a shell member 22 defining an inner space 21, a first sleeve portion 23 and a second sleeve portion 24, and the first and second sleeve portions 23, 24 respectively have openings communicating with the inner space 21. The shell member 22 is provided with a pin 25 disposed through the inner space 21 and a passage 26 between the first sleeve portion 23 and the second sleeve portion 24. The first sleeve portion 23, the second sleeve portion 24 and the passage 26 are disposed around an axis 251 of the pin 25, and the passage 26 and the slot 12 communicate with each other and are open toward a same direction. Either of the first and second sleeve portions 23, 24 has two corresponding abutting members 230, 240 which are substantially parallel to the axis 251 of the pin 25. One of the first and second sleeve portions 23, 24 (in this embodiment, the second sleeve portion 24) is entirely encompassed within the handle 10 and located on a longitudinal central axis 101 of the handle 10, and the longitudinal central axis 101 is substantially perpendicular to the axis 251 of the pin 25. Each of the abutting members 230, 240 is disposed laterally through the passage 26. The first sleeve portion 23 has a second blocking portion 231 or/and the second sleeve portion 24 has a third blocking portion 241. One of the first and second sleeve portions 23, 24 is a closed fram structure. In this embodiment, the first sleeve portion 23 and the second sleeve portion 24 are formed as aperture structures (closed fram structure), and the edges of the aperture structures serve as the second blocking portion 231 and the third blocking portion 241, respectively. It may be possible that only one of the first sleeve portion 23 and the second sleeve portion 24 is formed with a blocking portion, or the first sleeve portion 23 or/and the second sleeve portion 24 may be formed with recessed or protrusive blocking portions.

The driving rod 30 has a working end 31 and a fixation end 32 corresponding to the working end 31, and the fixation end 32 is formed with an elongate through hole 33 extending along a longitudinal direction of the driving rod 30. The working end 31 may be a socket jonitor, socket, and various types of screw drivers or driving head. A side surface of the fixation end 32 has a first blocking portion 321 for engagement with the first sleeve portion 23 or the second sleeve portion 24, or for engagement with the handle 10. Specifically, the first blocking portion 321 is preferably an elastically blocking assembly, and the elastically blocking assembly may include an elastic member received in the fixation end 32 and a blocking member (such as a ball body) embedded in the fixation end 32 and urged outwardly by the elastic member, in which the blocking member is selectively urged to move inwardly. The pin 25 is movably disposed within the elongate through hole 33, and the fixation end 32 is disposed into the inner space 21 through the slot 12 and the passage 26. The driving rod 30 is slidable and swingable relative to the pin 25, and the fixation end 32 is controllably selectively inserted into the first sleeve portion 23 or the second sleeve portion 24 and the fixation end 32 abuts against the two abutting members (230 or 240) of one of the first and second sleeve portions 23, 24 so that the driving rod 30 is held and retained. However, the first blocking portion 321 may be omitted.

Preferably, the fixation end 32 is provided with two planes 322 which are substantially parallel to each other and perpendicular to the axis 251 of the pin 25. The shell member 22 has two side walls 221 which are substantially parallel to the two planes 322, and the pin 25 is coupled substantially perpendicularly to the two side walls 221. Specifically, the elongate through hole 33 penetrates through the two planes 322, the pin 25 is disposed through the side walls 221 and the elongate through hole 33, and two ends of the pin 25 are detachably coupled to the handle 10. The formation of the two planes 322 of the fixation end 32 can reduce the thickness of the fixation end 32 so that the handle 10 can have small dimensions and the elongate through hole 33 is easy to form. Preferably, the fixation end 32 includes at least one shoulder 323. In this embodiment, each of two sides of the fixation end 32 which are located between the two planes 322 is formed with a shoulder 323. A distance between the outmost points of the two shoulders 323 is great than the first sleeve portion 23 and the second sleeve portion 24 (aperture structures) in radial dimension. The two shoulders 323 can provide abutment of the first sleeve portion 23 or the second sleeve portion 24 there against when the fixation end 32 is inserted into the first sleeve portion 23 or the second sleeve portion 24.

The elongate through hole 33 has a first side 331 adjacent to an end surface of the fixation end 32 and a second side 332 corresponding to the first side 331. When the pin 25 is located at the second side 332 of the elongate through hole 33, the fixation end 32 is inserted and held within the first sleeve portion 23 or the second sleeve portion 24 and the first blocking portion 321 is located outside the shell member 22 and engaged with the second blocking portion 231 or the third blocking portion 241; when the pin 25 is located at the first side 331 of the elongate through hole 33, the fixation end 32 is disengaged from the first sleeve portion 23 or the second sleeve portion 24 and the driving rod 30 is swingable within the passage 26 about the pin 25. In this embodiment, relative to the axis 251 of the pin 25, the first sleeve portion 23 and the second sleeve portion 24 are arranged by an included angle of 90 degrees so that the handle 10 and the driving rod 30 can be configured to form a coaxially or perpendicularly combined structure. It is noted that the first sleeve portion 23 and the second sleeve portion 24 can be arranged by any of optional included angles, or the limitation member 20 may be provided with more than two sleeve portions which may be equiangularly or non-equiangularly arranged, whereby the operation angle of the driving rod 30 relative to the handle 10 is adjustable for requirements according various operation spaces or conditions.

Preferably, the handle 10 further includes a first recess 13 corresponding to the first sleeve portion 23 and a second recess 14 corresponding to the second sleeve 10, portion 24. When the pin 25 is located at the second side 332, the fixation end 32 is inserted and held within the first sleeve portion 23 and the first recess 13, or inserted and held within the second sleeve portion 24 and the second recess 14; when the pin 25 is located at the first side 331, the fixation end 32 is disengaged from the first sleeve portion 23 and the first recess 13 or disengaged from the second sleeve portion 24 and the second recess 14, and the driving rod 30 is swingable within the passage 26 about the pin 25. It is noted that the first recess 13 and the second recess 14 can be omitted.

Preferably, the handle 10 has two fourth blocking portions 15 respectively adjacent to the first sleeve portion 23 and the second sleeve portion 24. When the pin 25 is located at the second side 332, the first blocking portion 321 is engaged with the fourth blocking portion 15 so that the fixation end 32 is more stable. In this embodiment, partial inner surfaces of the first recess 13 and the second recess 14 serve as the two fourth blocking portions 15. Preferably, the two fourth blocking portions 15 and the first blocking portion 321 are complementary in shape, for example, complementary structure of cocave/convex or convex/cocave, which can enhance engagement of the fixation end 32 and the limitation member 20.

Figure 4:
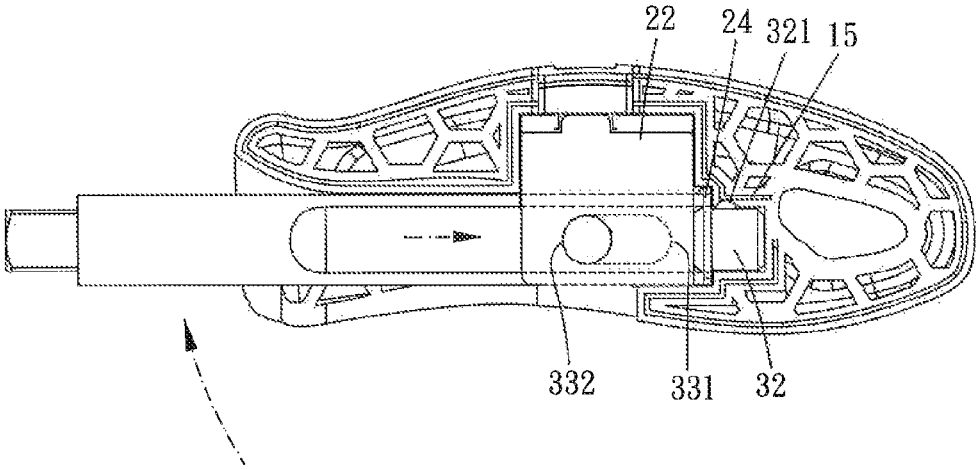
Figure 5:
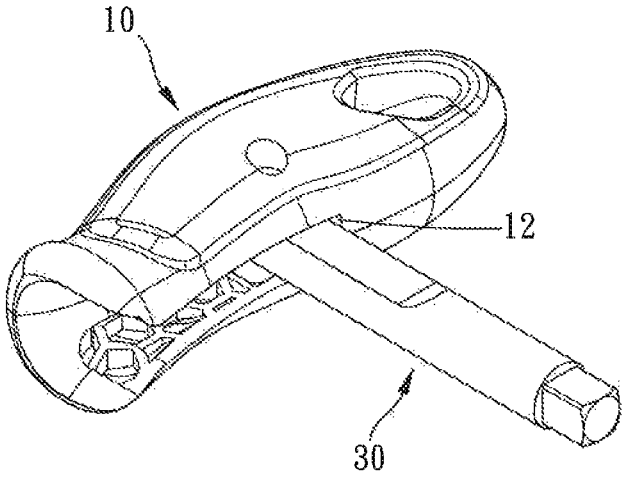
FIG. 5 is a perspective view according to the first embodiment of the present invention.
Figure 6:
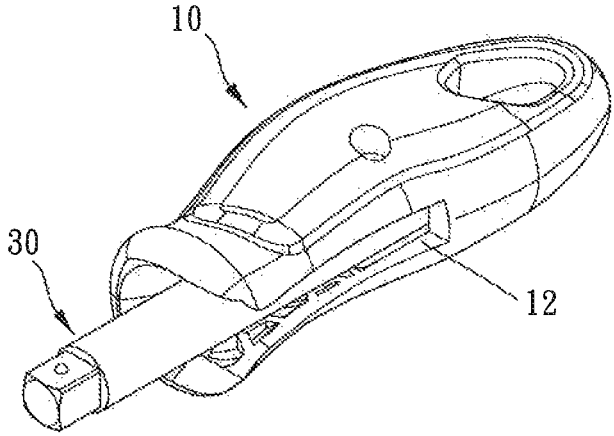
FIG. 6 is another perspective view according to the first embodiment of the present invention.

As shown in FIGS. 1 and 2, when the pin 25 is located at the second side 332 of the elongate through hole 33, the fixation end 32 is inserted into the first sleeve portion 23 and extends partially outside the first sleeve portion 23, outside-extended part of the fixation end 32 is further in the first recess 13, and the first blocking portion 321 is engaged with the second blocking portion 231 (edge of aperture structure) and the inner surface of the first recess 13 from an outside of the shell member 22. The first blocking portion 321 and the two shoulders 323 are located by two sides of the shell member 22 and can retain axial movement of the driving rod 30, and the driving rod 30 and the handle 10 substantially perpendicular to each other (as shown in FIG. 5). As shown in FIGS. 1 and 3, when the driving rod 30 moves away from the handle 10 and the pin 25 is located at the first side 331 of the elongate through hole 33, engagement of the first blocking portion 321 and the shell member 22 is released and the first blocking portion 321 is disengaged from the first sleeve portion 23, and the fixation end 32 is in the inner space 21, so that the driving rod 30 is movable and swingable within the passage 26 about the pin 25. As shown in FIGS. 1, 3 and 4, when the driving rod 30 swings and an end surface of the fixation end 32 faces the second sleeve portion 24, the fixation end 32 is inserted into the second sleeve portion 24 so that the first blocking portion 321 is engaged with the third blocking portion 241 (edge of aperture structure) and the inner surface of the second recess 14 from the outside of the shell member 22. The first blocking portion 321 and the two shoulders 323 are located by two sides of the shell member 22 can retain axial movement of the driving rod 30, and the driving rod 30 and the handle 10 substantially coaxial (as shown in FIG. 6).

Figure 7:
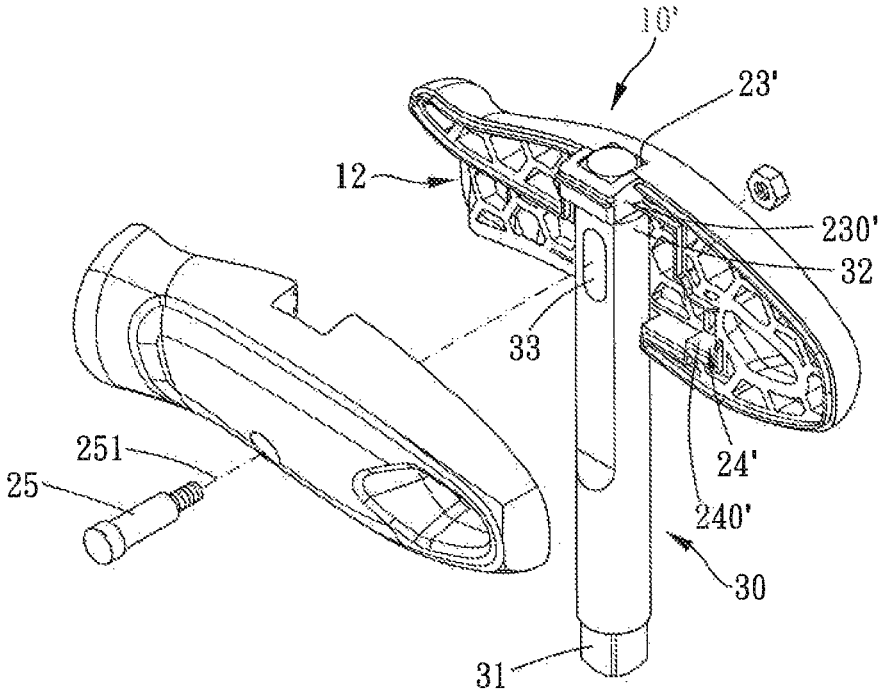
FIG. 7 is an exploded view according to a second embodiment of the present invention.
Figure 8:
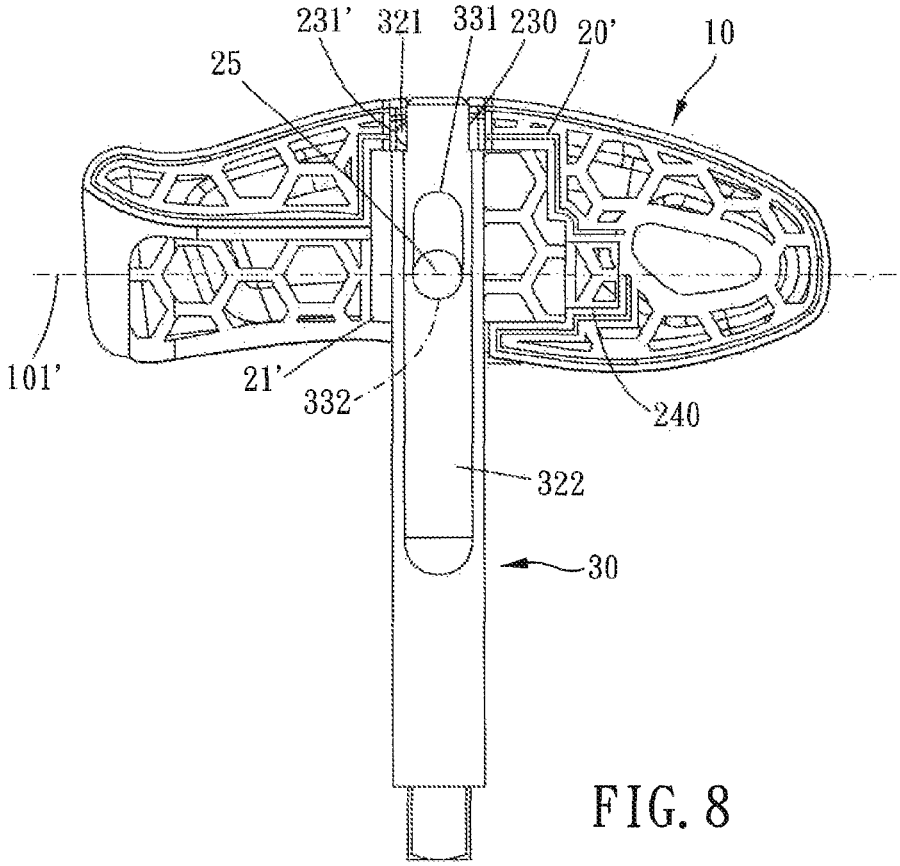
FIG. 8 is a cross-sectional view according to the second embodiment of the present invention.
Figure 9:
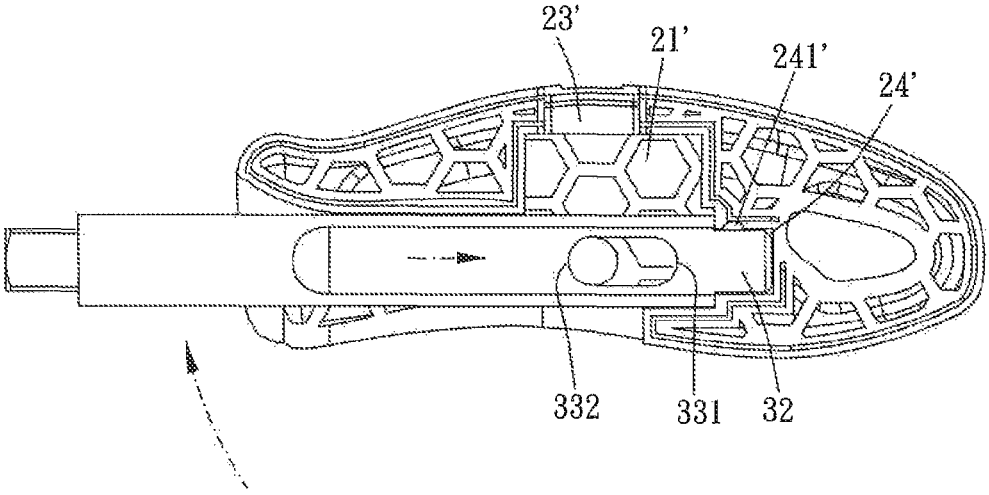
FIG. 9 is another cross-sectional view according to the second embodiment of the present invention.

As shown in FIGS. 7 to 9, compared to the first embodiment, an adjustable driving tool in a second embodiment does not have a limitation member. A handle 10' of the adjustable driving tool is provided with a limitation structure itself. More specifically, the handle 10' includes a limiting portion 20' and a slot 12. The limiting portion 20' is disposed in the handle 10' and includes an inner space 21', a first sleeve portion 23' and a second sleeve portion 24'. The first sleeve portion 23' and the second sleeve portion 24' communicate with the inner space 21'. Either of the first and second sleeve portions 23', 24' has two corresponding abutting members 230', 240' which are substantially perpendicular to a longitudinal central axis 101' of the handle 10'. One of the first and second sleeve portions 23', 24' (in this embodiment, the second sleeve portion 24') is entirely encompassed within the handle 10' and on the longitudinal central axis 101' of the handle 10'. In this embodiment, the first sleeve portion 23' and the second sleeve portion 24' are recessed structures formed in the handle 10'. The recessed structure may be a blind hole or through hole. The slot 12 communicates with the inner space 21' and is open to an outside of the handle 10', and the handle 10' is provided with a pin 25 disposed through the inner space 21'. The first sleeve portion 23' and the second sleeve portion 24' are disposed around the axis 251 of the pin 25. The fixation end 32 of the driving rod 30 is disposed into the inner space 21' through the slot 12, the driving rod 30 is slidable and swingable relative to the pin 25, and the fixation end 32 is controllably selectively inserted into the first sleeve portion 23' or the second sleeve portion 24' and the fixation end 32 abuts against the two abutting members (230' or 240') of one of the first and second sleeve portions 23', 24' so that the driving rod 30 is held and retained. When the pin 25 is located at the second side 332 of the elongate through hole 33, the first blocking portion 321 is engaged with the second blocking portion 231' of the first sleeve portion 23' (for example, inner surface of a recessed structure, which is preferably formed with concave or convex structure) or the third blocking portion 241' of the second sleeve portion 24' (for example, inner surface of a recessed structure, which is preferably formed with concave or convex structure). Parts the same as those in the first embodiment are designated with the same numerals and no more described in detail.

Figure 10:
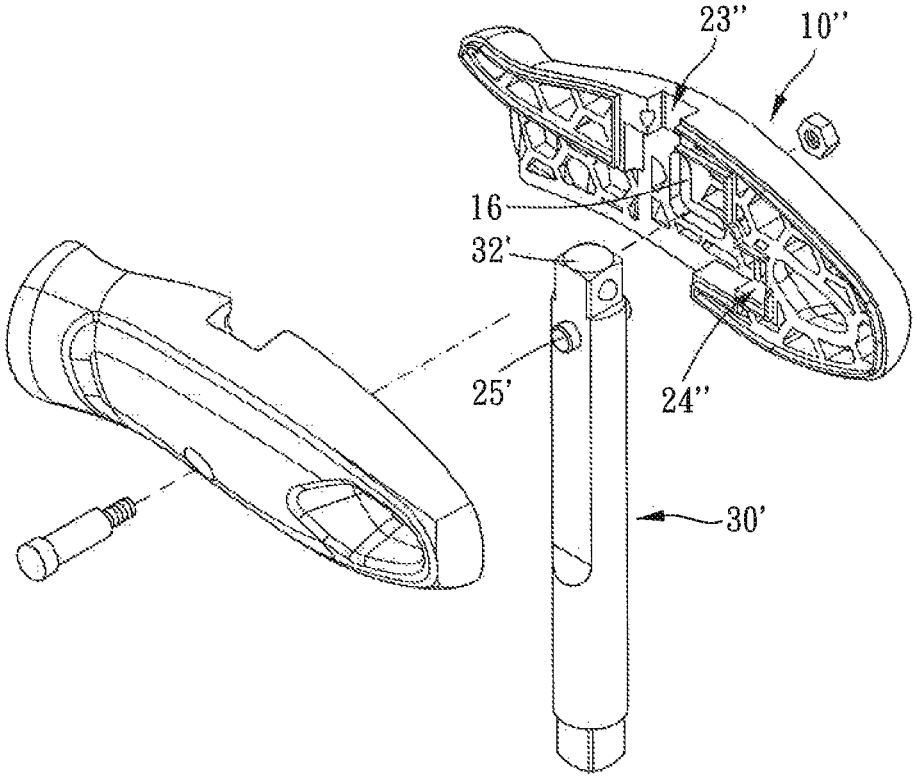
FIG. 10 is an exploded view according to a third embodiment of the present invention.
Figure 11:
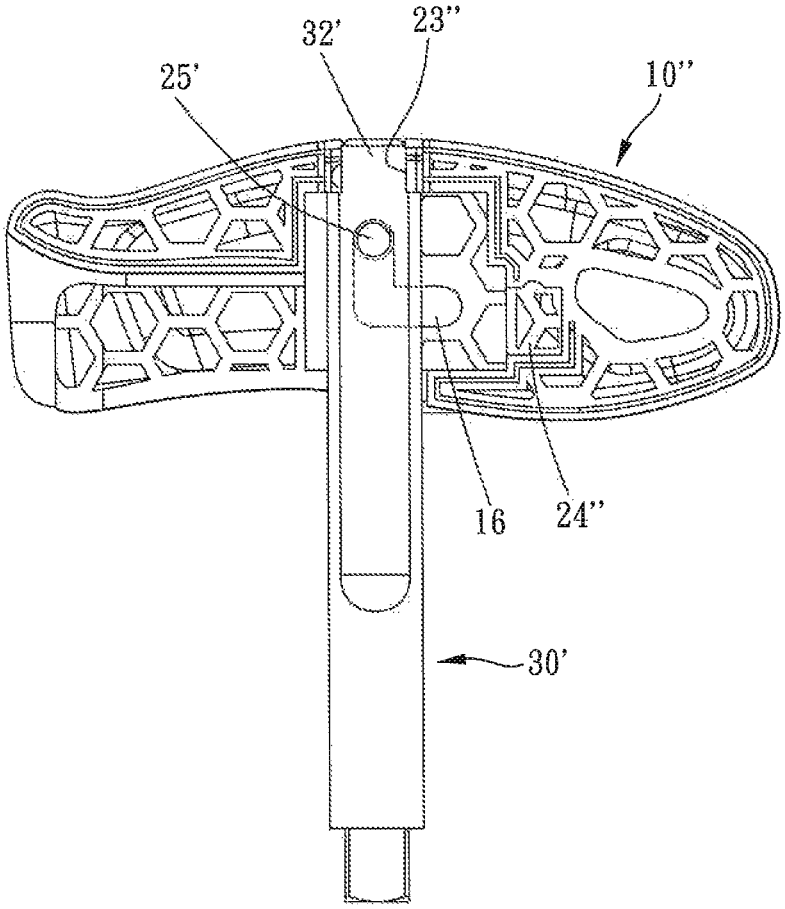
FIG. 11 is a cross-sectional view according to the third embodiment of the present invention.

As shown in FIGS. 10 and 11, compared to the first embodiment, a handle 10" of an adjustable driving tool in a third embodiment is provided with a groove 16 there inside. The groove 16 at least includes two elongate sections which communicate with each other and extend respectively toward a first sleeve portion 23" and a second sleeve portion 24". In this embodiment, the groove 16 is substantially L-shaped, or may be crisscross-shaped. A driving rod 30' of the adjustable driving tool is provided with a pin 25' (such as being disposed through the driving rod 30'), and the pin 25' is slidably inserted into the groove 16. The driving rod 30' is slidable and swingable within the groove 16, and a fixation end 32' of the pin 25' is controllably selectively inserted into the first sleeve portion 23" or the second sleeve portion 24". Taken FIG. 11 as an example, when the pin 25' relatively slides along the groove 16 to locate at the top portion of a vertical elongate section of the groove 16 and the fixation end 32' is inserted into the first sleeve portion 23", the driving rod 30' is held; when the pin 25' relatively slides along the groove 16 toward the intersection of the two elongate sections, the fixation end 32' is disengaged from the first sleeve portion 23" and becomes swingable, and the fixation end 32' selectively can slide along the groove 16 toward a right end of a transverse elongate section and is inserted into the second sleeve portion 24". Preferably, the handle 10" and the fixation end 32' may be formed with corresponding blocking portions for engagement. Parts the same as those in the first embodiment are designated with the same numerals and no more described in detail.

Through utilizing the the cooperation of the limiting portion and the driving rod which are relatively movable relative to each other, the adjustable driving tool can be simply and quickly adjusted according to various operation requirements or conditions. In additional, the adjustable driving tool has a simple structure, is easy to fabricate and of low production cost, and the driving rod can be effectively and stably held after adjusted.

Furthermore, the fixation end and the first sleeve portion or/and the second sleeve portion may be provided with blocking portions which are engagable with ach other, and the blocking portions can limit movement of the driving rod. The handle may be provided with recessed portions corresponding respectively to the first sleeve portion and the second sleeve portion, the recessed portions can further enhance the limiting effect to the driving rod after the driving rod is adjusted, and enhance the structural strength, thus avoiding insufficiency of great stress applied on the single limitation member and deformation.

Moreover, the handle may have hollow structures there inside, thus reducing usage of material, weight and production cost; besides, the handle may be detachable-type, so that the adjustable driving tool is easy to assemble, disassemble and replace.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An adjustable driving tool, including:

a handle, having a limiting portion and a slot, the limiting portion disposed in the handle and including an inner space, a first sleeve portion and a second sleeve portion, the first and second sleeve portions respectively having openings communicating with the inner space, the slot communicating with the inner space and being open to an outside of the the handle, the handle provided with a pin which is disposed through the inner space, the first sleeve portion and the second sleeve portion disposed around an axis of the pin, either of the first and second sleeve portions having two corresponding abutting members which are substantially parallel to the axis of the pin, one of the first and second sleeve portions being entirely encompassed within the handle and located on a longitudinal central axis of the handle, the longitudinal central axis being substantially perpendicular to the axis of the pin; and a driving rod, having a working end and a fixation end corresponding to the working end, the fixation end being formed with an elongate through hole extending along a longitudinal direction of the driving rod, the pin movably disposed in the elongate through hole, the fixation end disposed into the inner space through the slot, the driving rod being slidable and swingable relative to the pin, and the fixation end controllably selectively inserted into the first sleeve portion or the second sleeve portion and the fixation end abutting against the two abutting members of one of the first and second sleeve portions so that the driving rod is held.

2. The adjustable driving tool of claim 1, wherein the limiting portion has a limitation member fixedly disposed in the handle, the limitation member has a shell member having the inner space, the first sleeve portion and the second sleeve portion, the pin is disposed through the shell member and the inner space, the shell member is formed with a passage between the first sleeve portion and the second sleeve portion, the first sleeve portion, the second sleeve portion and the passage are disposed around the axis of the pin, the passage and the slot communicate with each other and are open toward a same direction, and the fixation end is disposed into the inner space through the slot and the passage.

3. The adjustable driving tool of claim 2, wherein each of the abutting members extends laterally through the passage.

4. The adjustable driving tool of claim 2, wherein one of the first and second sleeve portions is a closed fram structure.

5. The adjustable driving tool of claim 2, wherein the elongate through hole includes a first side adjacent one end of the fixation end and a second side corresponding to the first side, when the pin is located at the second side, the fixation end is inserted and held within the first sleeve portion or the second sleeve portion, and when the pin located at the first side, the fixation end is disengaged from the first sleeve portion or the second sleeve portion so that the driving rod is swingable about the pin.

6. The adjustable driving tool of claim 2, wherein the first sleeve portion and the second sleeve portion are aperture structures, a side surface of the fixation end has a first blocking portion for engagement with the first sleeve portion or the second sleeve portion.

7. The adjustable driving tool of claim 6, wherein the first sleeve portion has a second blocking portion or/and the second sleeve portion has a third blocking portion, and when the pin is located at the second side, the first blocking portion is engaged with the second blocking portion or the third blocking portion.

8. The adjustable driving tool of claim 2, wherein the fixation end includes at least one shoulder for abutment of the fixation end against the first sleeve portion or the second sleeve portion when the fixation end is inserted into the first sleeve portion or the second sleeve portion.

9. The adjustable driving tool of claim 8, wherein the at least one shoulder is abutted against the abutting member of the sleeve portion which is located in the handle and located on the longitudinal central axis of the handle when the fixation is inserted into the sleeve portion which is located in the handle and located on the longitudinal central axis of the handle.

10. The adjustable driving tool of claim 5, wherein the handle further includes a first recess corresponding to the first sleeve portion and a second recess corresponding to the second sleeve portion, when the pin located at the second side, the fixation end is inserted and held within the first sleeve portion and the first recess or within the second sleeve portion and the second recess, and when the pin is located at the first side, the fixation end is disengaged from the first sleeve portion and the first recess or disengaged from the second sleeve portion and the second recess and the driving rod is swingable about the pin.

11. The adjustable driving tool of claim 6, wherein the handle has two fourth blocking portions respectively adjacent to the first sleeve portion and the second sleeve portion, and when the pin is located at the second side, the first blocking portion is engaged with the fourth blocking portion.

12. An adjustable driving tool, including:

a handle, having a limiting portion, a slot and a groove, the limiting portion disposed in the handle and including an inner space, a first sleeve portion and a second sleeve portion, the first and second sleeve portions respectively having openings communicating with the inner space, either of the first and second sleeve portions having two corresponding abutting members which are substantially perpendicular to a longitudinal central axis of the handle, one of the first and second sleeve portions being entirely encompassed within the handle and on the longitudinal central axis of the handle, the slot communicating with the inner space and being open to an outside of the the handle, the groove at least including two elongate section respectively communicating with and extending toward the first sleeve portion and the second sleeve portion; and a driving rod, having a working end and a fixation end corresponding to the working end, the driving rod being provided with a pin, the fixation end disposed into the inner space through the slot, the pin slidably inserted into the groove, the driving rod being slidable and swingable within the groove through the pin and the fixation end controllably selectively inserted into the first sleeve portion or the second sleeve portion and the fixation end abutting against the two abutting members of one of the first and second sleeve portions so that the driving rod is held.

13. The adjustable driving tool of claim 12, wherein the groove is substantially L-shaped.

14. The adjustable driving tool of claim 12, wherein the first sleeve portion and the second sleeve portion are aperture structures, a side surface of the fixation end has a first blocking portion for engagement with the first sleeve portion or the second sleeve portion.

15. The adjustable driving tool of claim 14, wherein the first sleeve portion has a second blocking portion or/and the second sleeve portion has a third blocking portion, and the first blocking portion is for engagement with the second blocking portion or the third blocking portion.

* * * * *